US007121486B1

(12) United States Patent
Shimizu

(10) Patent No.: US 7,121,486 B1
(45) Date of Patent: Oct. 17, 2006

(54) CRUSHER

(75) Inventor: Masanori Shimizu, Sakaki-machi (JP)

(73) Assignee: Takeuchi Mfg. Co., Ltd., Nagaon (JP)

( * ) Notice: Subject to any disclaimer, the term of this patent is extended or adjusted under 35 U.S.C. 154(b) by 0 days.

(21) Appl. No.: 10/547,486

(22) PCT Filed: Mar. 14, 2005

(86) PCT No.: PCT/JP2005/004425

§ 371 (c)(1),
(2), (4) Date: Aug. 30, 2005

(51) Int. Cl.
*B02C 13/00* (2006.01)

(52) U.S. Cl. ..... 241/69; 241/91

(58) Field of Classification Search ..... 241/69, 241/91, 92, 277, 278.1, 242
See application file for complete search history.

(56) References Cited

U.S. PATENT DOCUMENTS 3,480,213 A * 11/1969 Shelton, Jr. ..... 241/92
3,545,687 A * 12/1970 Mosby ..... 241/66
4,390,132 A * 6/1983 Hutson et al. ..... 241/55
5,469,901 A * 11/1995 Leguin ..... 144/163

FOREIGN PATENT DOCUMENTS

| | | |
|---|---|---|
| JP | 39-2972 | 3/1964 |
| JP | 53-117666 | 10/1978 |
| JP | 59-26149 | 2/1984 |
| JP | 01-84753 | 6/1989 |
| JP | 2005-034743 | 2/2005 |

* cited by examiner

*Primary Examiner*—Faye Francis

(57) ABSTRACT

A crusher for crushing cooked wood chips or the like finely. A raw material to be crushed such as the cooked wood chips is delivered into a housing and clamped between stationary blades attached to a stationary plate housed in the upper end of the housing and rotary blades attached to a rotary plate rotating in the housing, so that it is finely crushed by the stationary blades and the rotary blades by making use of the planer principle. The crushed products are carried in the air flow, which is generated around a guide vane disc, which rotates in a through hole formed in a substantially central portion of the stationary plate, and forcibly delivered from an exit in the housing side wall front portion inclined forward, to the outside of the housing.

4 Claims, 6 Drawing Sheets

CRUSHER

TECHNICAL FIELD

The present invention relates to a crusher for crushing wood chips, trimmed plants, weeds, or the like cooked, into a powdery or near state.

BACKGROUND ART

In case the plants trimmed from roadside trees and the like or lawns or the like mowed from golf courses are to be burned, a complicated and large-sized incinerator is required to raise the cost by the recent regulations on dioxins emissions.

In recent years, therefore, there has been proposed a method for effectively using the trimmed plants, lawns, or the like as a fertilizer or a substitute for the soil by crushing them into a powdery or near state.

A crusher for crushing wood chips, trimmed plants, weeds, or the like into the powdery or near state is disclosed in JP-A-07-223208.

Patent Document 1: JP-A-07-223208

DISCLOSURE OF THE INVENTION

However, the crusher of the prior art described above has a complicated construction, in which two crushing rolls having crushing blades are made to mesh each other. This crusher is troublesome in its operations and maintenances and is expensive so that it has not spread widely.

In case the trimmed plants, the weeds, or the like are crushed as they are directly by the crusher, the cellulose fibers or lignin contained in large quantities in the wood chips, the trimmed plants or the weeds have made it difficult to crush the wood chips, the trimmed plants or the weeds into the powdery or near state. In view of this difficulty, therefore, it has been conceived that the wood chips, the trimmed plants or the weeds can be finely crushed easily and reliably into the powdery or near state, if the cellulose fibers or lignin contained in the large quantities in the wood chips, the trimmed plants or the weeds are beaten soft by using the cooking technique used generally in the prior art and if the wood chips, the trimmed plants or the weeds thus cooked are then crushed. Thus, a crusher according to that concept has been developed.

Here, the cooking treatment is to put wood chips in a cooking boiler thereby to boil them continuously under a pressure as high as about 20 atm. and at a temperature as high as about 200° C., for example, as disclosed in JP-A-2002-146690.

Specifically, the invention has a main object to provide a crusher for crushing wood chips, trimmed plants, weeds or the like, which have been cooked but contain cellulose fibers and lignin in large quantities, finely to a powdery or near state.

In order to achieve that object, according to the invention, there is provided a crusher characterized by comprising: a bottomed cylindrical housing; a cover member for closing the upper end opening of the housing; a stationary plate housed in the upper end of the inside of the housing and held in close contact with the back of the cover member; a rotary plate housed in the upper portion of the inside of the housing below the stationary plate and underlying the stationary plate; a spindle for supporting the rotary plate in the housing rotatably on the axis of the housing, the spindle has its leading end protruded into a through hole formed in a substantially central portion of the stationary plate; rotating means for rotating the spindle in a predetermined direction; a plurality of guide slots formed generally radially in the stationary plate around the through hole and communicating with the through hole; a guide vane disc attached to the leading end of the spindle for rotating together with the spindle in the through hole; a plurality of small holes arranged in the surface portion of the rotary plate underlying the stationary plate, at a predetermined pitch and vertically through the rotary plate; stationary blades attached along one-side edges of the individual guide slots of the stationary plate located on the side to rotate the rotary plate by the rotating means, and raised at an inclination opposite from the rotating direction of the rotary plate, the stationary blades having their edges positioned close to the surface of the rotary plate; a plurality of band-shaped rotary blades attached to those surface portions of the rotary plate, which overlap the path of the stationary blades, and raised substantially radially at an inclination in the rotating direction of the rotary plate as to follow the arranged state of the stationary blades, the rotary blades having their edges positioned sufficiently close to the back of the stationary plate so as not to abut against the edges of the stationary blades; an exit disposed in the side wall front portion of the housing for delivering such crushed products to the outside of the housing as have fallen down into the lower space in the housing through the small holes arranged in the surface portion of the rotary plate; support means for supporting the housing in such a forward inclination on the ground or on the floor of a building that the housing side wall front portion having the exit is directed obliquely downward; and an entrance opened in a central portion of the cover member for delivering a raw material to be crushed, and delivers the raw material into the through hole of the stationary plate through the cover member.

In the crusher thus constructed, the raw material such as the cooked wood chips, trimmed plants, weeds, or the like can be delivered from the crushed raw material entrance opened in the central portion of the cover member closing the upper end opening of the housing, through the cover member into the through hole which is formed at the central portion of the stationary plate housed in the upper end of the housing.

At the same time, the spindle can be rotated in the predetermined direction by the rotating means thereby to rotate the rotary plate and the guide vane disc mounted on the leading end of the spindle, together with the spindle. The raw material to be crushed, as delivered into the through hole in the central portion of the stationary plate, can be pumped into the individual guide slots which are generally radially formed in the stationary plate leading to and surrounding the through hole fitted with the guide vane disc, by the wind pressure of the air flow, which is generated by the vanes of the guide vane disc rotating in the through hole and directed from the guide vane disc to the circumference.

Next, the raw material thus pumped to each of the plurality of guide slots of the stationary plate can be delivered in the rotating direction of the rotating rotary plate in such a state of being carried on the surface portion of the rotary plate directed to the inner bottoms of the guide slots, the rotary plate overlapping with the under part of the stationary plate and rotating in the predetermined direction. Moreover, the raw material being carried in the rotating direction of the rotary plate is clamped between the stationary blades and the rotary blades so that the raw material can be finely crushed with the edges of the stationary blades and the rotary blades by applying the principle of a planer. At this time, the stationary blades are attached along one side edges of the guide slots of the stationary plate, as located on the rotating side of the rotary plate, such that their edges are positioned close to the surface of the rotary plate and are raised and inclined in the direction opposite from the direction for rotating the rotary plate, and the rotary blades are attached to the rotary plate such that their edges are inclined close to the back of the stationary plate and in the direction to rotate the rotary plate so that they rotate together with the rotary plate. Then, the raw material being carried on the surface portion of the rotary plate and delivered in the rotating direction of the rotary plate can be prevented by the stationary blades and the rotary blades from invading, without being finely crushed, into the clearance between the surfaces of the rotary blades and the opposed back faces of the stationary plate.

The crushed products thus finely crushed by the stationary blades and the rotary blades are forced to fall down into the lower space in the housing below the rotary plate through each of the plurality of small holes arranged in the rotary plate, by the wind pressure of the air flow generated from the rotating guide vane disc to the circumference.

Since the housing is so supported on the ground or the floor of the building as is inclined forward to direct its side wall front portion having the exit downward by support means, the crushed products having fallen into the lower space in the housing can be forcibly delivered to the direction toward the exit opened in the side wall front portion of the housing, by making use of the gravity to be applied to the crushed products and the wind pressure of the air flow, which is generated from the rotating guide vane disc to the circumference and which flows into the lower space in the housing through the through hole and the guide slots formed in the stationary plate and through the small holes formed in the rotary plate. Then, the crushed products thus having fallen into the lower space in the housing are forcibly delivered from the exit in the side wall front portion of the housing to the outside of the housing by the wind pressure of the air flow, which is generated from the rotating guide vane disc to the circumference and flows into the lower space in the housing.

The crusher of the invention may be constructed to comprise: stationary blade adjusting means for adjusting the distance between the edges of the stationary blades and the surface of the rotary plate to a large or small value; and rotary blade adjusting means for adjusting the distance between the edges of the rotary blades and the back of the stationary plate to a large or small value.

In this case, the vertical distance between the edges of the stationary blades and the edges of the rotary blades can be adjusted to the size of the raw material such as the wood chips to be cramped between the edges of the stationary blades and the edges of the rotary blades and crushed, or to such a size of the crushed products to be attained as is smaller than the diameter of the small holes arranged in the surface of the rotary plate. Then the raw material can be crushed easily and properly to the crushed products of a desired diameter or less by the stationary blades and the rotating rotary blades.

The crusher of the invention may be constructed such that the rotary plate is so housed in the upper portion of the inside of the housing as can be replaced by another rotary plate having a plurality of small holes of a different diameter arranged in the surface portion thereof.

In this case, the rotary plate housed in the upper portion of the housing can be freely replaced by another one, in which small holes of a diameter matching the size of the raw material or the crushed products to be obtained by crushing the raw material to be crushed are arranged in the surface portion. Then, the crushed products smaller than the target ones can be properly selected to fall down into the lower space of the housing through the plurality of small holes arranged in the surface portion of the rotary plate and having a desired diameter.

A crusher of the invention may be constructed such that the rotating means includes rotating-speed adjusting means for adjusting the rotating speed of the spindle.

In this case, the rotating speed of the rotary plate and the guide vane disc to be rotated by the rotating means can be adjusted to a high or low speed by using the rotating speed adjusting means in accordance with the size of the raw material to be crushed such as the wood chips to be clamped between and crushed by the edges of the stationary blades and the edges of the rotating rotary blades or the size of the diameters of the small holes arranged in the surface of the rotary plate. The raw material to be crushed such as the wood chips can be crushed easily and reliably to the desired particle size or smaller. At the same time, an excessive load can also be prevented from being applied to the rotating means for rotating the rotary plate or the like, to which the rotary blades for crushing the raw material to be crushed are attached.

ADVANTAGE OF THE INVENTION

The crusher of the invention is advantageous in that it can crush the cooked wood chips, trimmed plants or weeds, or the like containing cellulose fibers or lignin in large quantities, finely into a powdery or substantially powdery state by using a convenient mechanism having a simple construction and capable of being easily manufactured.

DESCRIPTION OF REFERENCE NUMERALS AND SIGNS

| | |
|---|---|
| 10 | HOUSING |
| 12 | COVER MEMBER |
| 20 | STATIONARY PLATE |
| 22 | THROUGH HOLE |
| 24 | GUIDE SLOTS |
| 30 | ROTARY PLATE |
| 32 | SMALL HOLES |
| 40 | SPINDLE |
| 50 | GUIDE VANE DISC |
| 60 | ROTATING MEANS |
| 62 | ROTATING SPEED ADJUSTING MEANS |
| 70 | STATIONARY BLADES |
| 72 | STATIONARY BLADE ADJUSTING MEANS |
| 80 | ROTARY BLADES |
| 82 | ROTARY BLADE ADJUSTING MEANS |

-continued

| | |
|---|---|
| 90 | EXIT OF CRUSHED PRODUCTS |
| 100 | SUPPORT MEANS |
| 110 | ENTRANCE OF CRUSHED PRODUCTS |
| 120 | HOPPER |
| 200 | PAW MATERIAL TO BE CRUSHED |
| 220 | CRUSHED PRODUCTS |

BEST MODE FOR CARRYING OUT THE INVENTION

FIG. 1 to FIG. 7 show a preferred mode of a crusher of the invention. This crusher is described in the following.

This crusher is provided with a bottomed cylindrical housing 10 having its cylinder bottom sealed with a bottom plate 11, and this housing 10 has its upper end opening closed by a cover member 12.

Figure 3:
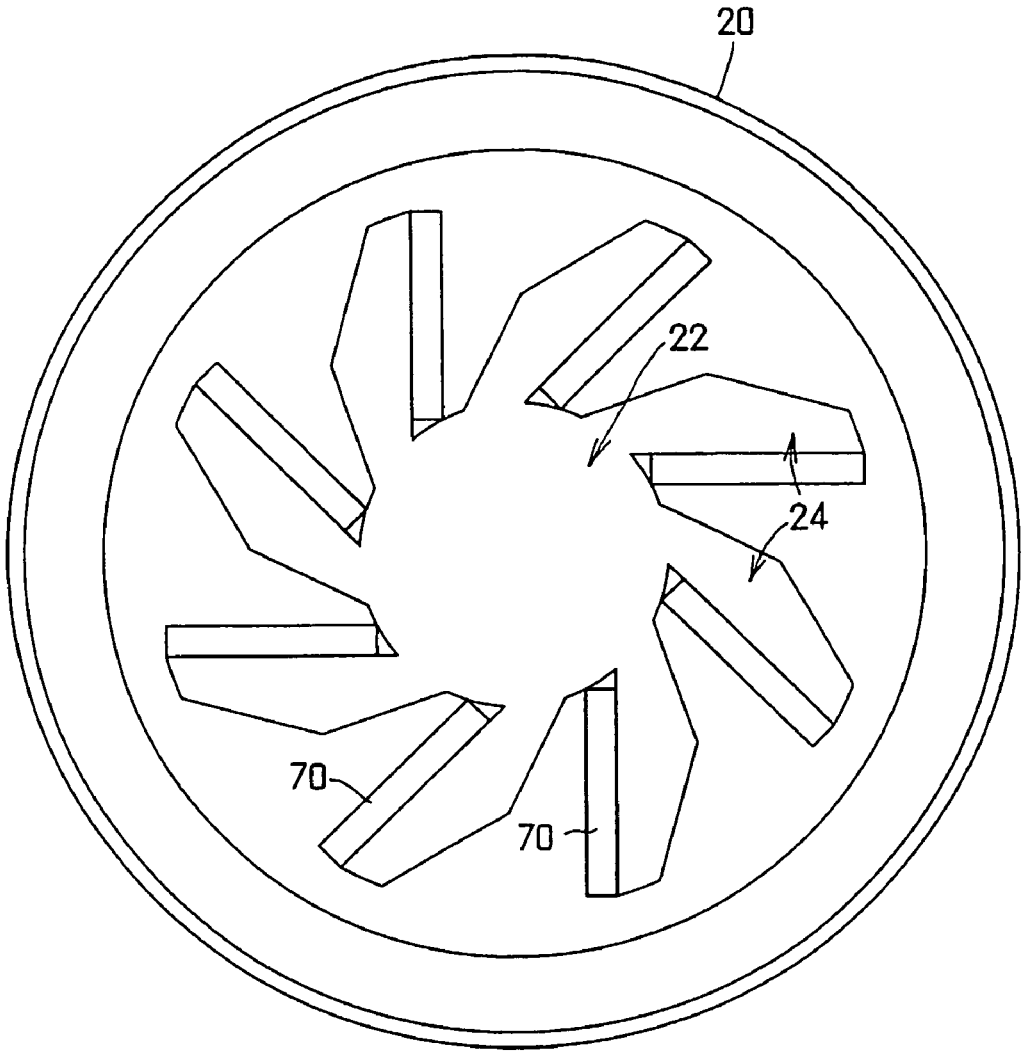
FIG. 3 is a top plan view of the stationary plate.

A thick stationary plate 20 having a generally circular disc shape, as shown in FIG. 3, is so housed in the upper end of the housing 10 as makes close contact with the back face of the cover member 12.

Figure 4:
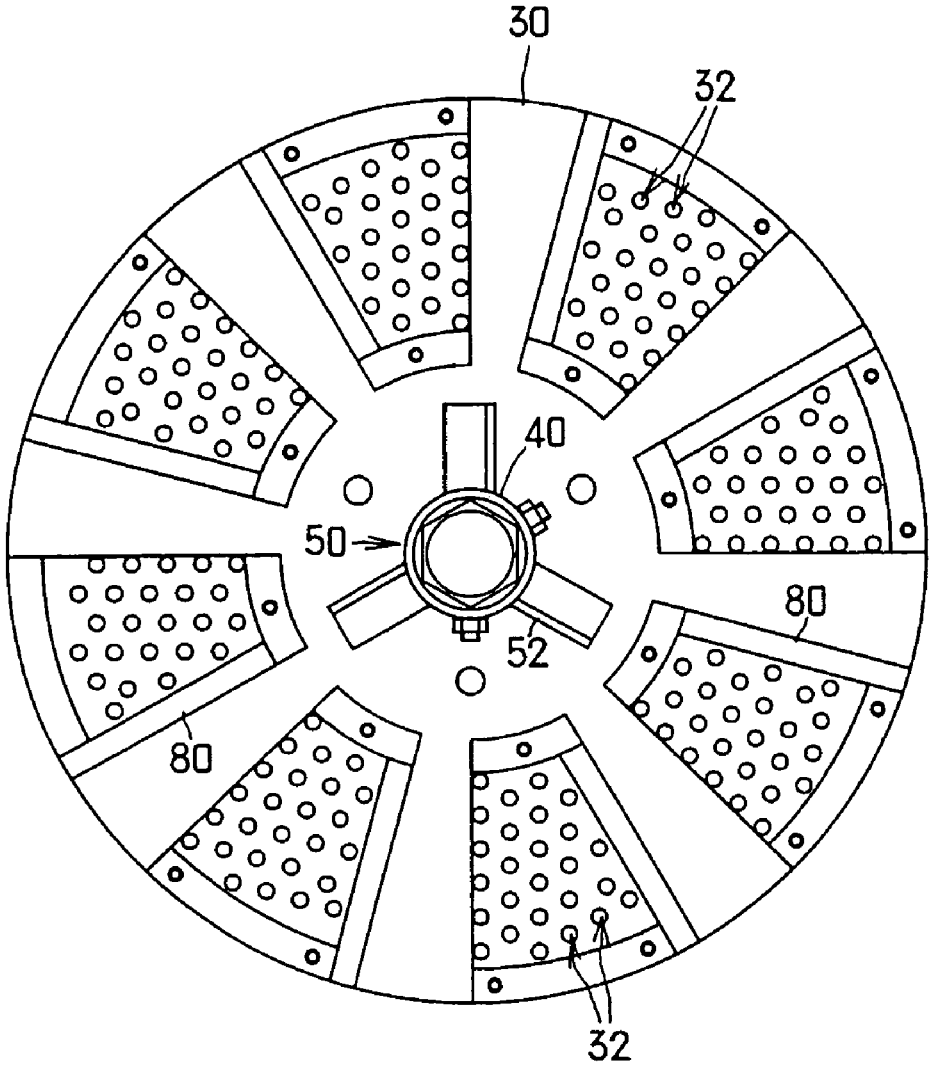
FIG. 4 is a top plan view of the rotary plate.

A rotary plate 30 having a generally circular disc shape, as shown in FIG. 4, is housed in the upper portion of the housing 10 below the stationary plate 20 so as to overlap the stationary plate 20.

A spindle 40 is disposed at a central portion in the housing 10 so as to extend through the bottom plate 11 of the housing and along the axis in the housing 10.

The rotary plate 30 is mounted around the intermediate portion of the spindle 40 so as to rotate together with the spindle 40 in the housing 10 and on the axis of the housing 10.

Figure 2:
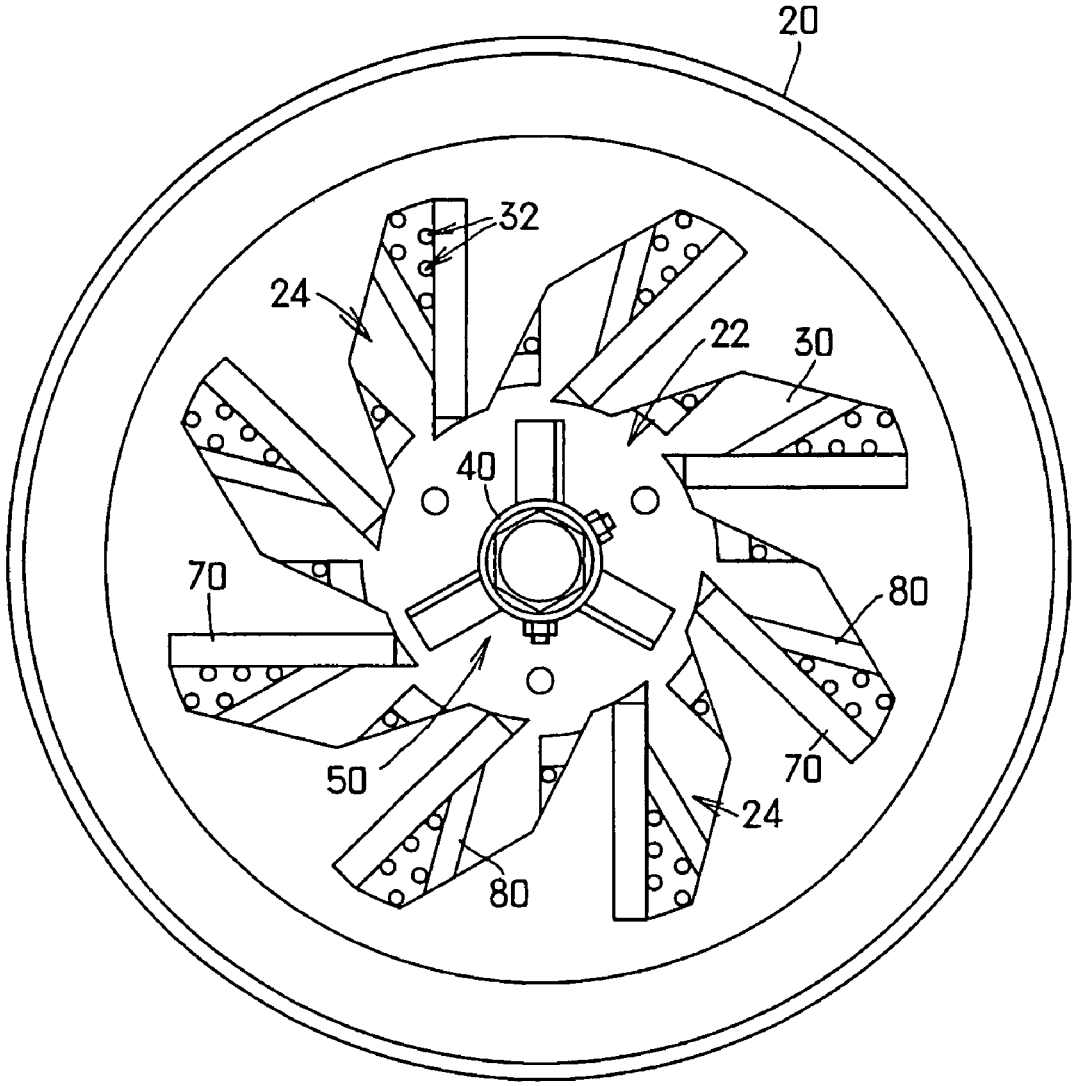
FIG. 2 is a top plan view of the state, in which a rotary plate underlies a stationary plate.

The leading end of the spindle 40 is protruded into a through hole 22 formed in the substantially central portion of the stationary plate 20, as shown in FIG. 2.

Figure 5:
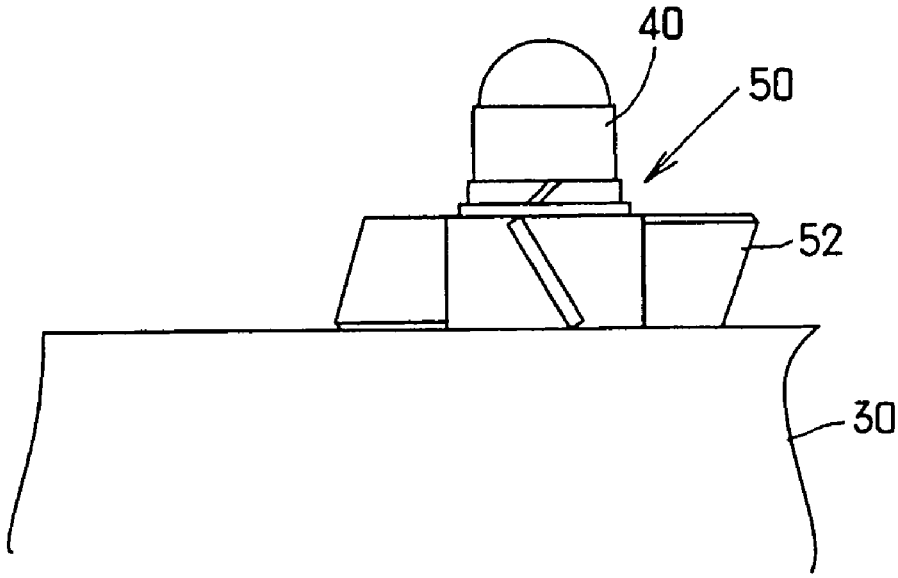
FIG. 5 is a front elevation of the vicinity of a guide vane disc.
Figure 6:
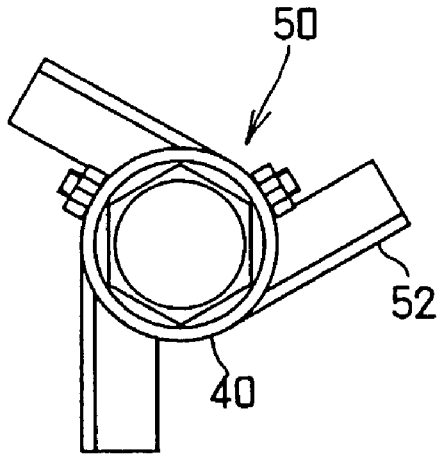
FIG. 6 is a top plan view of the guide vane disc.

On the leading end of the spindle 40 protruded into the through hole 22, as shown in FIG. 5 and FIG. 6, there is mounted a guide vane disc 50, from which a plurality of vanes 52 are radially protruded. The guide vane disc 50 has a construction to rotate together with the spindle 40 in the through hole 22.

On the outer side of the bottom plate 11 of the housing, there is disposed rotating means 60 for rotating the spindle 40 in a predetermined direction. The rotating means 60 uses an electric motor.

A plurality of guide slots 24 are so formed in the stationary plate 20 around the through hole 22 as to communicate with the through hole 22 substantially radially and vertically through the stationary plate 20, as shown in FIG. 2 and FIG. 3. A plurality of small holes 32 are formed, as shown in FIG. 4, in the surface portion of the rotary plate 30 underlying the stationary plate 20 and are arranged vertically through the rotary plate 30 and generally in radial band shapes at a predetermined pitch.

Figure 7:
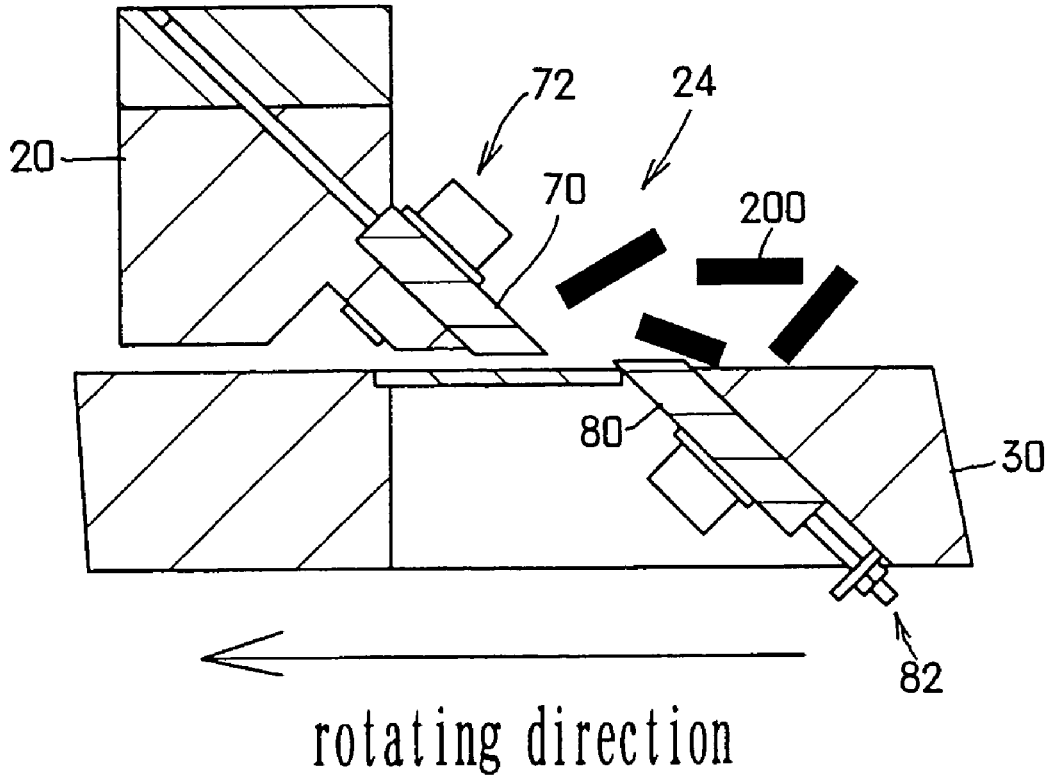
FIG. 7 is an explanatory diagram of a construction for mounting stationary blades and rotary blades of the crusher.

As shown in FIG. 3 and FIG. 7, band-shaped stationary blades 70 are attached along one-side edges of the individual guide slots 24 of the stationary plate located on the side to rotate the rotary plate 30 by the rotating means 60, and are raised at an inclination opposed from the rotating direction (as indicated by an arrow in FIG. 7) of the rotary plate 30. The stationary blades 70 have their edges positioned close to the surface of the rotary plate 30.

As shown in FIG. 4 and FIG. 7, a plurality of band-shaped rotary blades 80 are attached to those surface portions of the rotary plate 30, which overlap the path of the stationary blades 70, and are raised substantially radially at such an inclination in the rotating direction of the rotary plate 30 as to follow the arranged state of the stationary blades 70. The rotary blades 80 have their edges positioned substantially close to the back face of the stationary plate 20 so as not to abut against the edges of the stationary blades 70. As shown in FIG. 4, the rotary blades 80 are so attached to the rotary plate 30 between the portions, in which the small holes 32 are arranged generally in the radial band shape, as to vertically extend through the rotary plate 30.

In front of the side walls of the housing 10, there is disposed an exit 90 for delivering such crushed products 220 to the outside of the housing 10 as have fallen into the lower space in the housing 10 through the plurality of small holes 32 arranged in the surface portion of the rotary plate 30.

Figure 1:
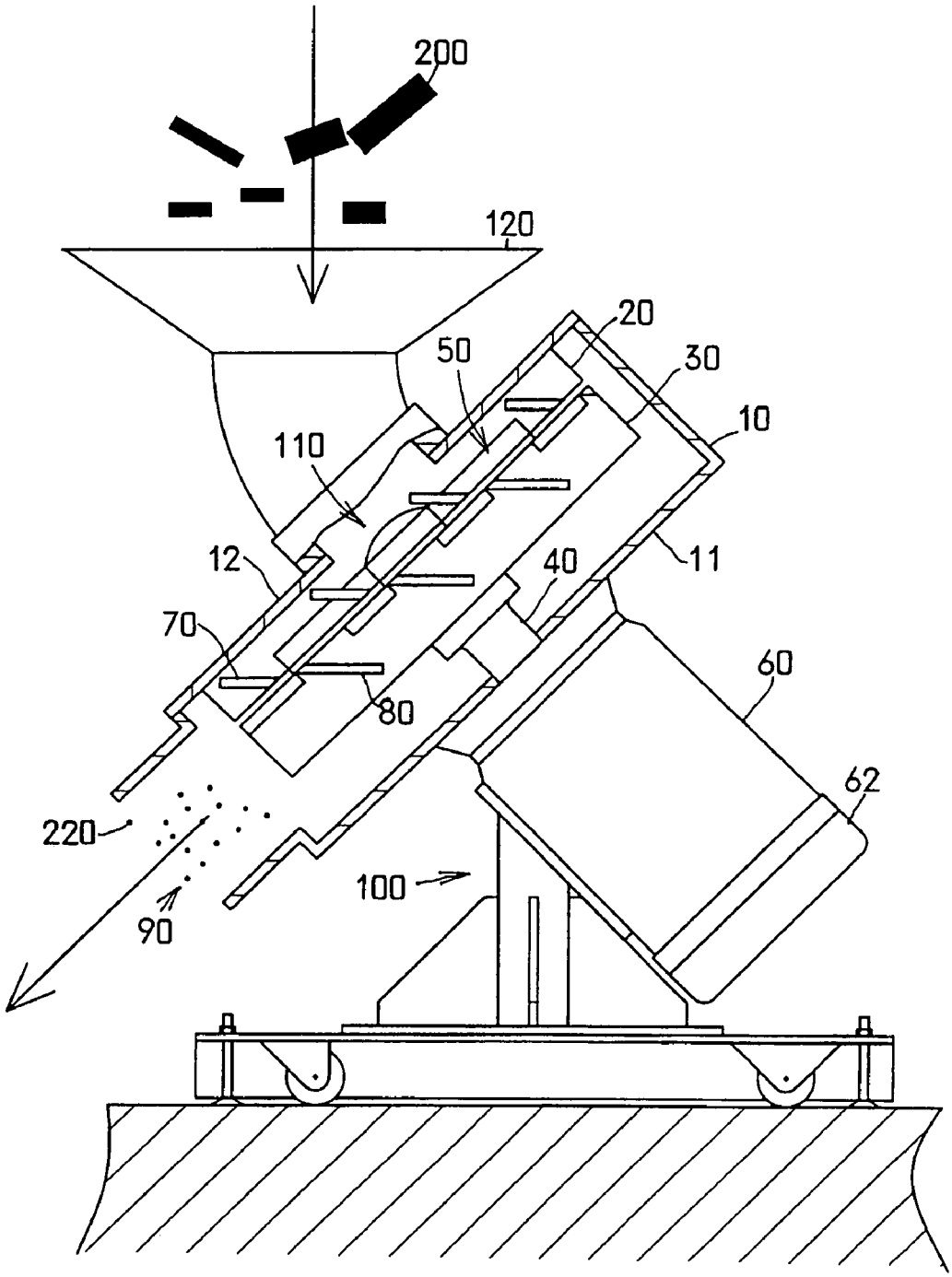
FIG. 1 is a schematic construction diagram of a crusher.

As shown in FIG. 1, the housing 10 is supported together with the rotating means 60 on support means 100. By this support means 100, the housing 10 is supported on the ground or the floor of a building at such a forward inclination that its side-wall front portion having the exit 90 may be directed obliquely downward. The support means 100 includes a truck having a horizontally holding mechanism, an arm erected from the truck and so on.

As shown in FIG. 1, the cover member 12 is opened at its central portion to form an entrance 110 for a raw material to be crushed. The raw material 200 to be crushed such as wood chips can be delivered through the entrance 110 and the cover member 12 into the through hole 22 of the stationary plate disposed in close contact with the back of the cover member 12.

The crusher shown in FIG. 1 to FIG. 7 is constructed in the following manner.

When the crusher is used, as shown in FIG. 1, the raw material 200 such as the cooked wood chips, trimmed plants or weeds is delivered from the entrance 110 of the raw materials to be crushed opened in the substantially central portion of the cover member 12 closing the upper end opening of the housing, through the cover member 12 into the through hole 22 which are formed at the substantially central portion of the stationary plate 20 housed in the upper end of the housing 10 and in close contact with the back of the cover member 12. At this time, the entrance 110 the raw material to be crushed may be equipped with a hopper 120 for delivering the raw material smoothly without any leakage into the entrance 110, as shown in FIG. 1.

At the same time, the spindle 40 is rotated in the predetermined direction by the rotating means 60 thereby to rotate the rotary plate 30 and the guide vane disc 50 mounted on the leading end of the spindle 40, together with the spindle 40. The raw material 200 to be crushed, as delivered into the through hole 22 in the central portion of the stationary plate 20, is pumped into the plurality of guide slots 24 which are generally radially formed in the stationary plate 20 leading to and surrounding the through hole 22 fitted with the guide vane disc 50, by the wind pressure of the air flow, which is generated by the vanes 52 of the guide vane disc 50 rotating in the through hole 22 and directed from the guide vane disc 50 to the circumference.

Next, the raw material 200 to be crushed thus pumped to each of the plurality of guide slots 24 of the stationary plate is delivered in the rotating direction of the rotating rotary plate 30 in such a state of, together with the rotating rotary plate 30, being carried on the surface portion of the rotary plate 30 directed to the inner bottoms of the guide slots 24, the rotary plate 30 overlapping with the under part of the stationary plate 20 and rotating in the predetermined direction. As shown in FIG. 7, moreover, the raw material 200 to be crushed being carried in the rotating direction of the rotary plate 30 is clamped between the stationary blades 70 and the rotary blades 80 so that the raw material 200 to be crushed is finely crushed with the edges of the stationary blades 70 and the rotary blades 80 by applying the principle of a planer. At this time, the stationary blades 70 are attached along one side edges of the guide slots 24 of the stationary plate, as located on the rotating side of the rotary plate 30, such that their edges are positioned close to the surface of the rotary plate 30 and are raised and inclined in the direction opposed from the direction for rotating the rotary plate 30. Moreover, the rotary blades 80 are attached to the rotary plate 30 such that their edges are inclined close to the back of the stationary plate 20 and in the direction to rotate the rotary plate 30 so that they rotate together with the rotary plate 30. Then, the raw material 200 to be crushed being carried on the surface portion of the rotary plate 30 and delivered in the rotating direction of the rotary plate 30 is prevented by the stationary blades 70 and the rotary blades 80 from invading, without being finely crushed, into the clearance between the surfaces of the rotary plate 30 and the opposed back faces of the stationary plate 20.

As shown in FIG. 1, the crushed products 220 thus finely crushed by the stationary blades 70 and the rotary blades 80 are forced to fall down into the lower space in the housing 10 below the rotary plate 30 through the plurality of small holes 32 arranged in the rotary plate 30, by the wind pressure of the air flow generated from the rotating guide vane disc 50 to the circumference.

Since the housing 10 is so supported on the ground or the floor of the building as is inclined forward to direct its side wall front portion having the exit 90 downward by the support means 100, the crushed products 220 having fallen into the lower space in the housing 10 is forcibly delivered to the direction toward the exit 90 opened in the side wall front portion of the housing 10, by making use of the gravity to be applied to the crushed products 220 and the wind pressure of the air flow, which is generated from the rotating guide vane disc 50 to the circumference and which flows into the lower space in the housing 10 through the through hole 22 and the guide slots 24 formed in the stationary plate and through the small holes 32 formed in the rotary plate. Then, the crushed products 220 thus having fallen into the lower space in the housing 10 are forcibly delivered from the exit 90 in the side wall front portion of the housing into the (not-shown) receptacle or the like outside of the housing 10 by the wind pressure of the air flow, which is generated from the rotating guide vane disc 50 to the circumference and flows into the lower space in the housing 10. The crushed products 220 thus finely crushed to the diameter equal to or smaller than that of the small holes 32 formed in the rotary plate are deposited in that receptacle of the like.

While this crusher is being used, the air is forcibly sucked from the raw material entrance 110 into the housing 10 by the sucking action of the rotating guide vane disc 50 so that the air is continuously forced out to the outside of the housing 10 through the through hole 22 and the guide slots 24 formed in the stationary plate, the plurality of small holes 32 arranged in the rotary plate, the lower space in the housing 10 and the crushed product exit 90 in the side wall front portion of the housing 10. Almost all of the crushed products 220 thus finely crushed in the housing 10 are continuously forced out to the outside of the housing 10 without being left in the housing 10, by the air flow forced to circulate through the individual portions in the housing 10. Moreover, the crushed products 220 are prevented from being partially left to stick to or deposit on the individual portions in the housing 10.

Therefore, this crusher can eliminate the troublesome maintenances, in which the inside of the housing 10 might otherwise be periodically opened to clear the crushed products 220 left to stick to or deposit on the individual portions in the housing 10.

As shown in FIG. 7, this crusher is preferably constructed to include stationary blade adjusting means 72 for adjusting the distance between the edges of the stationary blades 70 and the surface of the rotary plate 30 to a large or small value, and rotary blade adjusting means 82 for adjusting the distance between the edges of the rotary blades 80 and the back of the stationary plate 20 to a large or small value.

It is also preferable that the vertical distance between the edges of the stationary blades 70 and the edges of the rotary blades 80 to be rotated can be adjusted to the size of the raw material 200 to be crushed such as the wood chips to be cramped between the edges of the stationary blades 70 and the edges of the rotary blades 80 and crushed, or to such a size of the crushed products 220 to be attained as is equal to or smaller than the diameter of the small holes 32 arranged in the surface of the rotary plate 30. It is further preferable that the raw material 200 to be crushed can be crushed easily and properly to the crushed products 220 of a desired diameter or less by the stationary blades 70 and the rotating rotary blades 80.

It is further preferable that the stationary blade adjusting means 72 and the rotary blade adjusting means 82 can adjust the mounted positions of the stationary blades 70 on the stationary plate 20 and the mounted positions of the rotary blades 80 on the rotary plate 30 by means of a screwing mechanism, for example, as shown in FIG. 7.

This crusher may be constructed such that the rotary plate 30 is so housed in the upper portion of the housing 10 that the plurality of small holes 32 arranged in the surface portion of the rotary plate 30 can be replaced by another rotary plate 30 of a different diameter.

The rotary plate 30 housed in the upper portion of the housing 10 may also be freely replaced by another rotary plate 30, in which small holes 32 of a diameter of 3 to 6 mm matching the size of the raw material 200 to be crushed or the crushed products 220 to be obtained by crushing the raw material 200 to be crushed are arranged in the surface portion. Then, the crushed products 220 smaller than the target ones may be properly selected to fall down into the lower space of the housing 10 through the plurality of small holes 32 arranged in the surface portion of the rotary plate 30.

This crusher may also be constructed such that the rotating means 60 is equipped with rotating speed adjusting means 62 for adjusting the rotating speed of the spindle 40.

Moreover, the rotating speed of the rotary plate 30 and the guide vane disc 50 to be rotated by the rotating means 60 may be adjusted to a high or low speed by using the rotating speed adjusting means 62 in accordance with the size of the raw material 200 such as the wood chips to be clamped between the edges of the stationary blades 70 and the edges of the rotating rotary blades 80 and crushed or the size of the diameters of the small holes 32 arranged in the surface of the rotary plate 30. The raw material 200 such as the wood chips may be crushed easily and reliably to the desired particle size. At the same time, an excessive load may also be prevented from being applied to the rotating means 60 such as the electric motor for rotating the rotary plate 30 or the like, to which the rotary blades 80 for crushing the raw material 200 to be crushed are attached.

The rotating speed adjusting means 62 may be exemplified by an inverter control mechanism for accelerating/decelerating the rotating speed of the electric motor of the rotating means 60 continuously to 0 to 1,730 r.p.m., for example.

INDUSTRIAL APPLICABILITY

The crusher of the invention can be widely applied to one for crushing the cooked wood chips, trimmed plants, weeds, or the like containing cellulose fibers or lignin in large quantities, finely into a powdery or substantially powdery state.

The crusher of the invention can also be widely applied to one for crushing the uncooked relatively soft trimmed plants, weeds, or the like finely into a powdery or substantially powdery state.

The invention claimed is:

1. A crusher characterized by comprising: a bottomed cylindrical housing; a cover member for closing the upper end opening of said housing; a stationary plate housed in the upper end of the inside of the housing and held in close contact with the back of said cover member; a rotary plate housed in the upper portion of the inside of the housing below said stationary plate and underlying the stationary plate; a spindle for supporting said rotary plate in the housing rotatably on the axis of the housing, said spindle has its leading end protruded into a through hole formed in a substantially central portion of said stationary plate; rotating means for rotating said spindle in a predetermined direction; a plurality of guide slots formed generally radially in the stationary plate around said through hole and communicating with the through hole; a guide vane disc attached to the leading end of said spindle for rotating together with the spindle in the through hole; a plurality of small holes arranged in the surface portion of the rotary plate underlying said stationary plate, at a predetermined pitch and vertically through the rotary plate; stationary blades attached along one-side edges of the individual guide slots of the stationary plate located on the side to rotate the rotary plate by said rotating means, and raised at an inclination opposite from the rotating direction of the rotary plate, said stationary blades having their edges positioned close to the surface of the rotary plate; a plurality of band-shaped rotary blades attached to those surface portions of said rotary plate, which overlap the path of the stationary blades, and raised substantially radially at an inclination in the rotating direction of the rotary plate as to follow the arranged state of the stationary blades, said rotary blades having their edges positioned sufficiently close to the back of the stationary plate so as not to abut against the edges of said stationary blades; an exit disposed in the side wall front portion of the housing for delivering such crushed products to the outside of the housing as have fallen down into the lower space in the housing through the small holes arranged in the surface portion of said rotary plate; support means for supporting the housing in such a forward inclination on the ground or on the floor of a building that the housing side wall front portion having said exit is directed obliquely downward; and an entrance opened in a central portion of said cover member for delivering a raw material to be crushed, and delivers the raw material into the through hole of said stationary plate through the cover member.

2. A crusher according to claim 1, characterized by comprising: stationary blade adjusting means for adjusting the distance between the edges of said stationary blades and the surface of the rotary plate to a large or small value; and rotary blade adjusting means for adjusting the distance between the edges of said rotary blades and the back of the stationary plate to a large or small value.

3. A crusher according to claim 1, characterized in that said rotary plate is so housed in the upper portion of the inside of the housing as can be replaced by another rotary plate having a plurality of small holes of a different diameter arranged in the surface portion thereof.

4. A crusher according to claim 1, characterized in that said rotating means includes rotating speed adjusting means for adjusting the rotating speed of said spindle.

* * * * *